US011952861B2

(12) United States Patent
Hofacker et al.

(10) Patent No.: US 11,952,861 B2
(45) Date of Patent: Apr. 9, 2024

(54) METHODOLOGY AND SYSTEM HAVING DOWNHOLE UNIVERSAL ACTUATOR

(71) Applicant: Schlumberger Technology Corporation, Sugar Land, TX (US)

(72) Inventors: Mark Hofacker, Sugar Land, TX (US); Jordi Juan Segura Dominguez, Tananger (NO); Jeffrey Conner McCabe, Houston, TX (US); Carlos Urdaneta, Houston, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 17/657,514

(22) Filed: Mar. 31, 2022

(65) Prior Publication Data

US 2023/0313640 A1 Oct. 5, 2023

(51) Int. Cl.

| | |
|---|---|
| ***E21B 34/06*** | (2006.01) |
| ***E21B 23/04*** | (2006.01) |
| ***E21B 34/16*** | (2006.01) |

(52) U.S. Cl.

CPC ..... *E21B 34/066* (2013.01); *E21B 23/0419* (2020.05); *E21B 34/16* (2013.01)

(58) Field of Classification Search

CPC ..... E21B 23/0419; E21B 23/04; E21B 23/00; E21B 23/042; E21B 23/06; E21B 34/066

See application file for complete search history.

(56) References Cited

U.S. PATENT DOCUMENTS

| | | | |
|---|---|---|---|
| 4,913,231 | A | 4/1990 | Muller et al. |
| 6,176,318 | B1 | 1/2001 | Drakeley et al. |
| 6,543,544 | B2 | 4/2003 | Schultz et al. |

(Continued)

FOREIGN PATENT DOCUMENTS

| | | |
|---|---|---|
| CN | 206458407 | 9/2017 |
| EP | 2281105 B1 | 12/2018 |

(Continued)

OTHER PUBLICATIONS

PCT International Search Report and Written Opinion; Application No. PCT/US2023/017018; dated Jul. 28, 2023; 11 pages.

(Continued)

*Primary Examiner* — Kipp C Wallace

(74) *Attorney, Agent, or Firm* — Rushi C. Sukhavasi

(57) ABSTRACT

A technique facilitates control over a downhole well operation. The technique utilizes an electronic control system for controlling actuation of a downhole application-specific attachment. According to an embodiment, the system comprises a universal actuator module which may be selectively combined with a variety of application-specific attachments, e.g. well tools. The universal actuator module is electrically powered via, for example, electricity supplied to drive an electric motor which, in turn, may be used to drive a hydraulic pump or other type of mechanical device. Additionally, a given application-specific attachment can be readily interchanged with other application-specific attachments (e.g. well tools) for performing a desired downhole operation or operations.

18 Claims, 2 Drawing Sheets

(56) References Cited

U.S. PATENT DOCUMENTS

| | | | | |
|---|---|---|---|---|
| 7,051,810 | B2 * | 5/2006 | Clemens | E21B 31/00 166/117.6 |
| 7,967,067 | B2 | 6/2011 | Irani et al. | |
| 9,890,611 | B2 | 2/2018 | Lee et al. | |
| 10,006,282 | B2 | 6/2018 | Livescu et al. | |
| 10,385,680 | B2 | 8/2019 | Livescu et al. | |
| 10,876,377 | B2 | 12/2020 | Quero et al. | |
| 10,947,794 | B2 | 3/2021 | Noui-Mehidi | |
| 2004/0026086 | A1 | 2/2004 | Patel | |
| 2007/0295515 | A1 * | 12/2007 | Veneruso | E21B 34/066 166/66.6 |
| 2011/0147086 | A1 | 6/2011 | Hummes et al. | |
| 2011/0168403 | A1 * | 7/2011 | Patel | E21B 34/08 166/373 |
| 2012/0048561 | A1 | 3/2012 | Holderman | |
| 2012/0085539 | A1 * | 4/2012 | Tonnessen | E21B 43/119 166/55 |
| 2013/0014939 | A1 * | 1/2013 | Martinez | E21B 23/00 166/381 |
| 2013/0192848 | A1 * | 8/2013 | Patel | E21B 34/06 166/373 |
| 2014/0083689 | A1 | 3/2014 | Streich et al. | |
| 2014/0196953 | A1 | 7/2014 | Chitwood et al. | |
| 2014/0352955 | A1 | 12/2014 | Tubel et al. | |
| 2015/0136425 | A1 | 5/2015 | Burgos et al. | |
| 2016/0115753 | A1 * | 4/2016 | Frazier | E21B 43/1185 166/66.4 |
| 2017/0191346 | A1 | 7/2017 | Nicholson | |
| 2017/0260834 | A1 | 9/2017 | Chacon et al. | |
| 2017/0284168 | A1 | 10/2017 | Zevenbergen et al. | |
| 2018/0023358 | A1 * | 1/2018 | Moyes | E21B 23/00 251/76 |
| 2018/0245428 | A1 * | 8/2018 | Richards | E21B 47/06 |
| 2018/0274331 | A1 | 9/2018 | Richards et al. | |
| 2019/0203538 | A1 | 7/2019 | Wisinger, Jr. et al. | |
| 2019/0226294 | A1 * | 7/2019 | Hansen | E21B 29/005 |
| 2019/0316440 | A1 | 10/2019 | Honeker et al. | |
| 2020/0115992 | A1 | 4/2020 | Wang et al. | |
| 2020/0217197 | A1 | 7/2020 | Adebiyi | |
| 2020/0332613 | A1 * | 10/2020 | Al Hussin | E21B 23/042 |
| 2021/0131224 | A1 | 5/2021 | Radford et al. | |
| 2021/0254431 | A1 | 8/2021 | Prost | |
| 2021/0320578 | A1 | 10/2021 | Sheth et al. | |

FOREIGN PATENT DOCUMENTS

| | | | |
|---|---|---|---|
| EP | 3268831 | B1 | 9/2020 |
| WO | 03018955 | A1 | 3/2003 |
| WO | 2022016023 | | 1/2022 |

OTHER PUBLICATIONS

PCT International Search Report and Written Opinion; Application No. PCT/US23/017022: dated Jul. 12, 2023; 11 pages.

PCT International Search Report and Written Opinion; Application No. PCT/US23/016801: dated Jul. 12, 2023; 10 pages.

Office Action issued in U.S. Appl. No. 17/657,523 dated Sep. 14, 2023, 26 pages.

Office Action issued in U.S. Appl. No. 17/657,499 dated Oct. 5, 2023, 32 pages.

* cited by examiner

METHODOLOGY AND SYSTEM HAVING DOWNHOLE UNIVERSAL ACTUATOR

BACKGROUND

In many well applications, a well string is deployed downhole into a borehole, e.g. a wellbore. A given well string may comprise coiled tubing coupled with a bottom hole assembly (BHA). The bottom hole assembly may comprise a variety of well tools which are actuated downhole. For example, a given well tool may be actuated to a set position, to a unique fluid flow position, and/or to another selected operational position. In some well applications, the well tool/BHA is actuated by pushing or pulling on the coiled tubing while the BHA is anchored. Other well applications utilize pumping of fluid to create changes in pressure, changes in flow rate, or pressure in combination with dropping a ball to enable actuation of the well tool/BHA. However, designing well tools around such actuation constraints has led to complex mechanical designs and potentially unreliable service.

SUMMARY

In general, a methodology and system facilitate control over a downhole well operation. The technique utilizes an electronic control system for controlling actuation of a downhole well tool. According to an embodiment, the system comprises a universal actuator module which may be selectively combined with a variety of application-specific attachments, e.g. well tools. The universal actuator module is electrically powered via, for example, electricity supplied to drive an electric motor which, in turn, may be used to drive a hydraulic pump or other type of mechanical device. Additionally, a given application-specific attachment can be readily interchanged with other application-specific attachments (e.g. well tools) for performing a desired downhole operation or operations. By utilizing a universal actuator module and an application-specific attachment, multiple types of downhole jobs may be performed quickly and inexpensively.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

Figure 1:
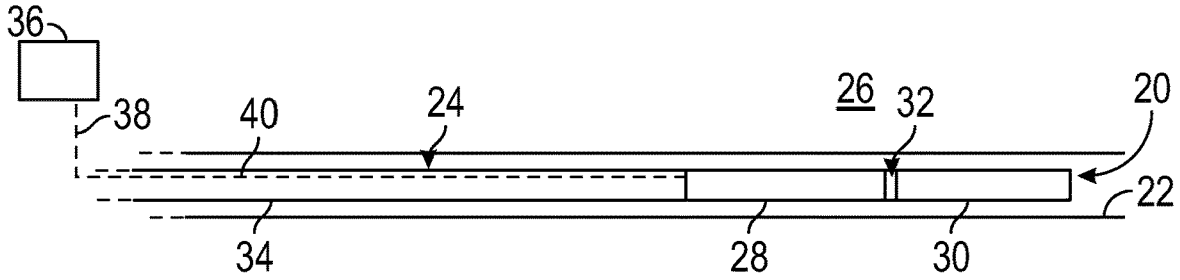
FIG. 1 is a schematic illustration of an example of a well system having a universal actuator module combined with an application-specific attachment, according to an embodiment of the disclosure.

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The disclosure herein generally involves a methodology and system which facilitate downhole well operations. The technique utilizes an electronic control system for controlling actuation of a downhole well tool. According to an embodiment, the system comprises a universal actuator module which may be selectively combined with a variety of application-specific attachments, e.g. well tools. For various downhole operations, the universal actuator module and combined application-specific attachment may be connected into a well string and deployed downhole to a desired location. In a specific example, the universal actuator module is coupled with coiled tubing which can accommodate internal fluid flows. An electrical cable may be routed downhole along the coiled tubing and used to carry power to the downhole universal actuator module. The electrical cable or other types of telemetry systems may be used to carry signals to and from the universal actuator module and other downhole equipment.

According to an embodiment, the universal actuator module may be electrically powered via, for example, electricity supplied to drive an electric motor which, in turn, may be used to drive a hydraulic pump or other type of mechanical device. Additionally, a given application-specific attachment may be readily interchanged with other application-specific attachments (e.g. well tools) for performing a desired downhole operation or operations. By utilizing a universal actuator module and an application-specific attachment, multiple types of downhole jobs may be performed quickly and inexpensively.

The technique described herein may be utilized to simplify many coiled tubing operations by providing downhole electric actuation. By separating the downhole tool system into a universal actuator module and an application-specific attachment, multiple kinds of jobs may be performed quickly and inexpensively. To rapidly transition the well string between runs, a different application-specific attachment may be easily added to the universal actuator module and another downhole job may be performed. For some operations, a field location is able to use one universal actuator module and multiple different application-specific attachments. According to one field strategy: after each job is run, the application-specific attachment may be separated from the universal actuator module and replaced with another application-specific attachment. The new/subsequent application-specific attachment may be a completely different well tool or a redressed version of the previous well tool.

This type of system and technique reduces development costs because the universal actuator module tends to be substantially more complex than the application-specific attachments. Additionally, overall total cost is reduced because multiple application-specific attachments may be used with a single universal actuator module. The ability to quickly interchange application-specific attachments also reduces rig-up time between runs downhole.

According to an embodiment, the universal actuator module may comprise hardware, e.g. a motor controller, for driving an electric motor. In some embodiments, the electric motor may be coupled with a hydraulic pump so as to drive the hydraulic pump to provide pressurized hydraulic oil. This pressurized hydraulic oil may be used to actuate a variety of application-specific attachments between desired, operational positions.

In some embodiments, however, the electric motor may be used to drive other types of devices. For example, the electric motor may be connected to or may comprise a lead screw which is constructed for direct or indirect connection with a corresponding application-specific attachment. The lead screw or other rotational component provides rotational actuation of the application-specific attachment. Additionally, the universal actuator module may comprise various sensors, e.g. pressure sensors, current sensors, voltage sensors, temperature sensors, to provide confirmation and control information to the surface and/or to other desired locations.

Furthermore, the selected application-specific attachment may be constructed in various configurations so as to receive mechanical power from the universal actuator module and to enable desired, application-specific functions. For example, the application-specific attachment may be constructed with a hydraulic piston which is shifted via pressurized hydraulic oil provided by the universal actuator module. In other embodiments, the application-specific attachment may be constructed to receive a rotational component, e.g. a driveshaft or lead screw, from the universal actuator module to enable direct actuation of the application-specific attachment via the rotational input. Some types of application-specific attachments also may comprise sensors to provide desired information, e.g. confirmation of proper function.

Referring generally to FIG. 1, an example of a well system 20 is illustrated as deployed in a borehole 22, e.g. a wellbore. The well system 20 is part of an overall well string 24 which is conveyed downhole into the borehole 22 to a desired position for operation. By way of example, borehole 22 may be in the form of a wellbore drilled into a formation 26 containing desirable hydrocarbons, such as oil and gas.

As illustrated, the well system 20 comprises a universal actuator module 28 and an application-specific attachment 30 which is connected to the universal actuator module 28 via a connector 32. The application-specific attachment 30 may comprise a well tool and/or work in cooperation with a well tool to enable performance of a desired operation downhole when actuated accordingly. The connector 32 may comprise a variety of connector types which facilitate the easy disconnection of application-specific attachment 30 followed by the subsequent connection of another type of application-specific attachment 30.

According to an operational example: after each job is run, one application-specific attachment 30 may be separated from the universal actuator module 28 and replaced with another application-specific attachment 30 to enable easy and rapid transition of the well string 24 between jobs. The connector 32 accommodates this rapid change and may comprise a threaded connector, a flange style connector, an insert and latch connector, or various other types of connectors 32 facilitating the decoupling and coupling of different application-specific attachments 30.

By way of example, the universal actuator module 28 may be coupled with coiled tubing 34. The coiled tubing may be used to convey the universal actuator module 28 and connected application-specific attachment 30 downhole to a desired location along borehole 22. In a well application, the universal actuator module 28 is positioned along well string 24 and also coupled with the desired application-specific attachment 30. The coiled tubing 34 is then used to deploy the module 28 and attachment 30 downhole to a desired wellbore location for performance of a well operation.

According to an embodiment, the universal actuator module 28 is electrically controlled so as to cause a specific actuation of the application-specific attachment 30. The universal actuator module 28 may comprise suitable hardware which is in communication with an electronic control system 36, e.g. a computer-based control system. The control system 36 may be used to provide electrical power and control signals to the universal actuator module 28. In some applications, the control system 36 may be located at the surface. However, other applications may utilize other types of control systems 36 which are located in whole or in part downhole along the well string 24.

An electric communication line 38 may be connected between the control system 36 and universal actuator module 28 to provide electrical power and to carry data signals, e.g. control signals, to and/or from the universal actuator module 28. Electric communication line 38 may comprise one or more electrical cables 40 able to carry the desired electrical power and/or data signals. However, data may be communicated from the surface to the universal actuator module 28 or vice versa via a variety of telemetry systems.

Figure 2:
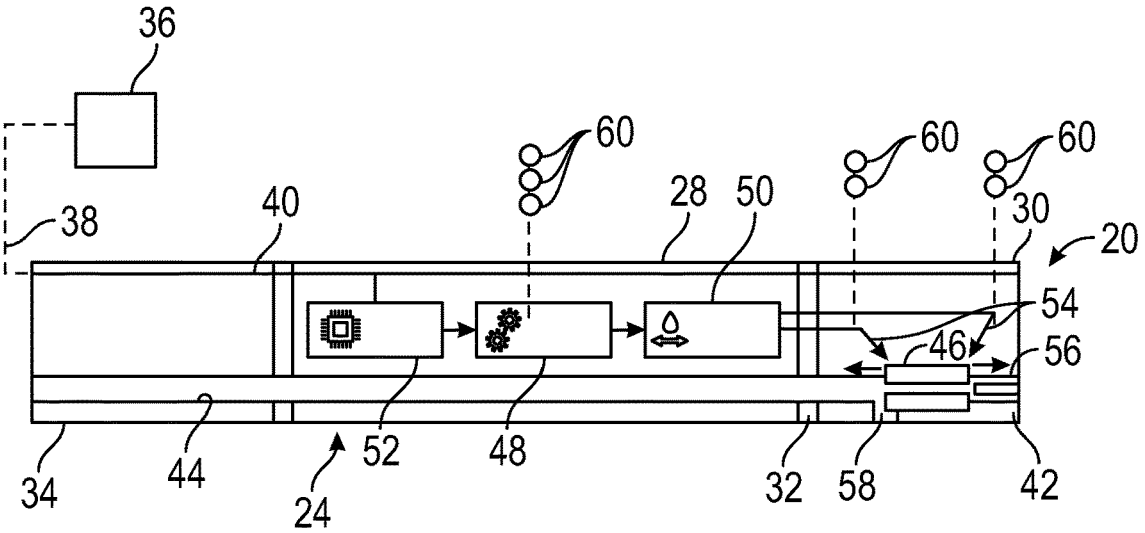
FIG. 2 is a schematic illustration of another example of a well system having a universal actuator module combined with an application-specific attachment, according to an embodiment of the disclosure.

Referring generally to FIG. 2, an embodiment is illustrated in which the application-specific attachment 30 comprises a valve 42 shiftable between a plurality of operational positions. The valve 42 is selectively shifted to control fluid flows directed along an interior 44 of the coiled tubing 34 and along the interior of overall well string 24. By way of example, the valve 42 may comprise a piston 46 which is movable/shiftable between different valve positions and thus different operational modes. The different valve positions are used to control the flow of fluid along interior 44 so as to direct that fluid in performance of a desired downhole well operation. For example, the flow of fluid along interior 44 may be directed to another well tool or to another portion of the application-specific attachment 30. The valve 42 may comprise various operational positions for directing the fluid flow along interior 44 to desired locations.

In the embodiment illustrated, the universal actuator module 28 is constructed to receive electrical power and to respond to electronic control signals so as to hydraulically actuate piston 46 between operational flow positions. By way of example, the universal actuator module 28 may comprise a motor 48, a pump 50 connected to the electric motor 48, and a motor controller 52 which receives electronic control signals via electric control line 38 and control system 36. The electrical power and control signals provided are used to control operation of the motor 48 and thus of application-specific attachment 30 which, in this example, comprises valve 42. According to an embodiment, the motor 48 and pump 50 may be constructed as a positive displacement motor and pump combination.

Depending on the parameters of a given application, the motor controller 52 may comprise various control boards and may be programmable with control algorithms which enable the reliable actuation and monitoring of the valve 42 (or other attachment 30). Based on control signals sent from the surface, the motor controller 52 controls the speed and/or direction of operation of motor 48. This operation of motor 48, in turn, controls the direction and speed of pump 50. In this example, pump 50 is a bi-directional pump.

The motor controller 52 also may process monitoring data and provide corresponding information to the surface to facilitate surface control. Effectively, the motor controller 52 works in cooperation with control system 36 to establish an overall electronic control system for controlling actuation of the downhole valve 42 (or other application-specific attachment 30). The valve 42, in the example illustrated, is operated to enable selective control over fluid flows affecting downhole operations, e.g. fluid flows for actuating well tools.

The bi-directional pump 50 includes or is supplied with hydraulic actuating fluid which is delivered to piston 46 of valve 42 via actuation flowlines 54. Thus, by operating pump 50 in a given direction via motor 48 according to control instructions provided by control system 36 to motor controller 52, the piston 46/valve 42 may be shifted to desired operational positions. For example, by directing hydraulic actuating fluid flow to one side of piston 46, the piston 46 (and thus valve 42) is shifted to an operational flow position which directs fluid flowing along interior 44 to a first flow path 56 for performance of a desired downhole operation.

If hydraulic actuating fluid flow is directed to the other side of piston 46 along the appropriate flowline 54, the piston 46 (and thus valve 42) is shifted in an opposite direction to another operational flow position. As a result, fluid flowing along interior 44 is directed to a second flow path 58 for performance of a different, desired downhole operation. As illustrated, the valve 42 is shiftable between two operational flow positions. However, the valve 42 may be constructed for shifting between three or more positions depending on the downhole operations to be performed.

In this example, each of the universal actuator module 28 and the application-specific attachment 30 includes sensors 60. The sensors 60 may be positioned at various locations to provide data related to operation of the universal actuator module 28 and/or application-specific attachment 30. For example, data from some of the sensors 60 may be used to monitor the position of piston 46 and/or to provide other operational data. The data from sensors 60 may be provided to the motor controller 52 and to the surface control system 36 for use in determining appropriate control signals to be sent downhole.

The sensors 60 may comprise many types of sensors. For example, sensors 60 may comprise pressure sensors, temperature sensors, position sensors, current sensors, voltage sensors, or various other types of sensors used in desired combinations. The data from sensors 60 may be processed in a variety of ways to facilitate monitoring of the operation and performance of downhole equipment, e.g universal actuator module 28 and application-specific attachment 30.

By way of example, the sensors 60 may comprise pressure sensors which may be positioned, for example, along flowlines 54 on opposite sides of piston 46. Data obtained by pressure sensors may be used to deduce valve position via the hydraulic pressure measurements and pressure differentials on opposite sides of piston 46. In some embodiments, the sensors 60 may comprise temperature sensors which may be similarly located along flowlines 54 on opposite sides of piston 46. The temperature sensors may be used to assist in monitoring the operational position of valve 42 and/or the temperature of motor 48.

The sensors 60 also may comprise a variety of other sensors, such as a voltage sensor to monitor voltage associated with motor 48. Similarly, the sensors 60 may comprise a current sensor to monitor current associated with operation of motor 48. The sensors 60 also may comprise a speed sensor which may be used to monitor the rotations and/or rotational speed of motor 48. This type of data may be used, for example, to map corresponding pump rotations so as to estimate the position of piston 46 based on displacement of hydraulic fluid through flowlines 54. Various other sensors 60 also may be used to provide desired data for monitoring operation of valve 42. The data from sensors 60 may be processed in a variety of ways to facilitate monitoring of the operation and performance of valve 42 and/or other application specific attachments 30 and/or other components of well system 20.

Figure 3:
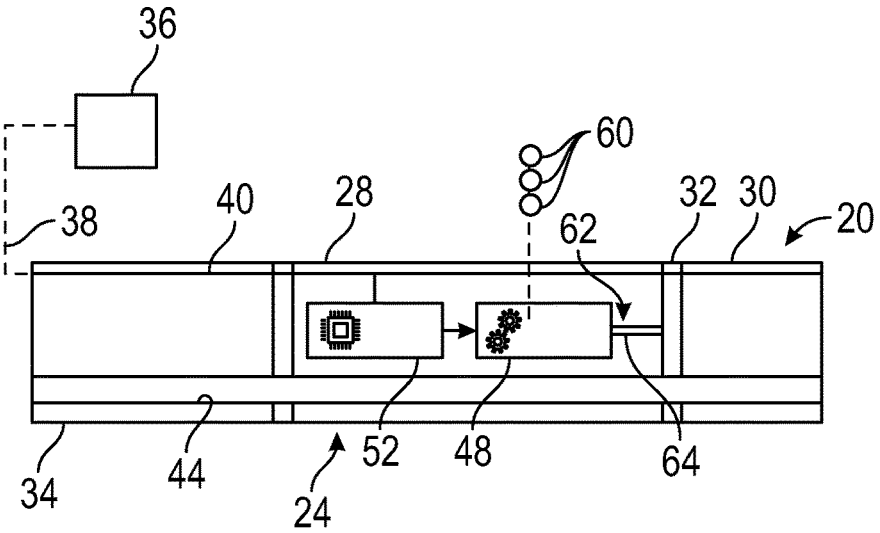
FIG. 3 is a schematic illustration of another example of a well system having a universal actuator module combined with an application-specific attachment, according to an embodiment of the disclosure.

Referring generally to FIG. 3, another example of well system 20 is illustrated in which the application-specific attachment 30 is actuated via rotational input. In this embodiment, the electric motor 48 of universal actuator module 28 is operatively engaged with the application-specific attachment 30 via a rotational mechanism 62. By way of example, the rotational mechanism 62 may be in the form of a lead screw/driveshaft 64 coupled between motor 48 and application-specific attachment 30. The rotational mechanism 62 may be an extension of the motor shaft of electric motor 48. In this type of arrangement, the rotational motion of mechanism 62 is used to actuate the application-specific attachment 30 between different operational positions.

Figure 4:
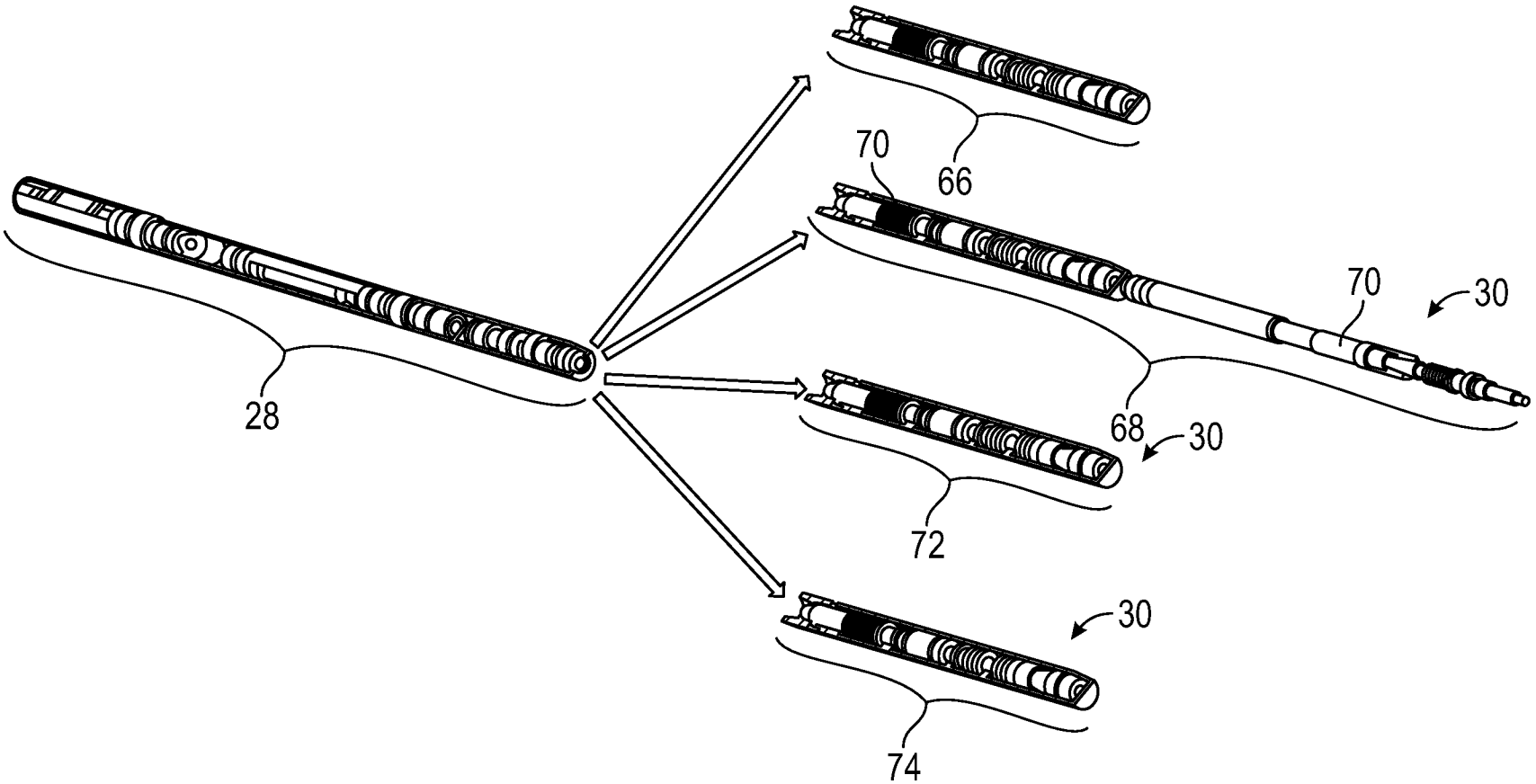
FIG. 4 is a schematic illustration of another example of a well system having a universal actuator module which may be selectively combined with various illustrated application-specific attachments, according to an embodiment of the disclosure.

Referring generally to FIG. 4, an example of well system 20 is illustrated as comprising universal actuator module 28 and a plurality of corresponding application-specific attachments 30. The desired application-specific attachment 30 for a given downhole job or operation may be selected and coupled with the universal actuator module 28. The combined module 28 and attachment 30 may then be conveyed downhole into wellbore 22 (or other type of borehole 22) for performance of a desired well operation. Subsequently, the well system 20 may be withdrawn and another one of the application-specific attachments 30 may be interchanged with the previous application-specific attachment for use in a different well operation during another run downhole.

In the example illustrated, one of the application-specific attachments 30 is a multi-cycle circulating valve 66 which may be shifted between operational positions via the electronically controlled universal actuator module 28. By way of example, the multi-cycle circulating valve 66 may be actuated between a first position in which fluid flow along interior 44 continues past the well system 20 and a second stroked position in which a percentage of the flow, e.g. 95%, is directed to annular exit ports while the remaining percentage is directed down along interior 44. In this example, the valve 66 also may have a third position in which 100% of the flow is directed through the annular exit ports.

Referring again to FIG. 4, another illustrated example of the application-specific attachment 30 is a straddle packer 68 which may be shifted between operational positions via the electronically controlled universal actuator module 28. By way of example, the straddle packer 68 may be actuated between a first position in which fluid flow along interior 44 is directed to the annulus for circulation and a second position in which the fluid is directed to packers 70 to inflate the packers. In this example, the straddle packer 68 also may have a third position in which fluid flow is directed into straddle exit ports for an injection operation.

According to another illustrated example, the application-specific attachment 30 may comprise an emergency disconnect and circulation sub 72 which may be shifted between operational positions via the electronically controlled universal actuator module 28. By way of example, the emergency disconnect and circulation sub 72 may be actuated between a first position for standard operation and a second position in which the fluid is directed to the annulus for circulation. In this example, the emergency disconnect and circulation sub 72 also may have a third position which enables emergency disconnection.

In FIG. 4, another illustrated example of the application-specific attachment 30 is a multilateral reentry system 74 which may be shifted between operational positions via the electronically controlled universal actuator module 28. By way of example, the multilateral reentry system 74 may be actuated between a first position in which the multilateral reentry system 74 is in a straight orientation with fluid flowing downwardly and a second position in which the multilateral reentry system 74 kicks and rotates a certain angular amount, e.g. 15°. The rotation may be used to facilitate alignment with a lateral window.

The examples illustrated are provided to demonstrate the versatility and flexibility of utilizing a single universal actuator module 28 with various application-specific attachments 30. However, a variety of additional types of application-specific attachments 30 may be used with actuator module 28. Examples of application-specific attachments 30 include a concentric coiled tubing attachment which may be shifted between operational positions via the electronically controlled universal actuator module 28. For example, the concentric coiled tubing attachment may be actuated between a first position in which 100% of the fluid flow moves down through the interior 44 of the coiled tubing 34 and a second position in which a percentage of the fluid flow, e.g. 80%, goes to vacuum and the rest of the flow continues down through interior 44. In this example, the concentric coiled tubing attachment also may have a third position in which 100% of the fluid flow goes to vacuum.

Another example of application-specific attachment 30 comprises an inflation attachment which may be actuated to inflate a desired element downhole. The inflation attachment may be shifted between operational positions via the electronically controlled universal actuator module 28. For example, the inflation attachment may be actuated between a first position in which 100% of the flow through interior 44 goes downhole for circulation and a second position in which 100% of the flow goes to the inflation element. The inflation attachment also may comprise a third position in which 100% of flow goes to annular exit ports for circulation. A potential fourth position enables disconnection.

Another example of application-specific attachment 30 comprises a sampling attachment which may be actuated to collect samples downhole. The sampling attachment may be shifted between operational positions via the electronically controlled universal actuator module 28. For example, the sampling attachment may be actuated between a first position in which 100% of the flow along interior 44 goes to the annulus and a second position in which the fluid flow is used to compress a packer element and to close the annulus. Shifting the sampling attachment to a third position triggers sample bottle actuation to enable collection of a sample downhole.

Another example of application-specific attachment 30 comprises an equalizing valve attachment which may be used for pressure buildup tests. The equalizing valve attachment may be shifted between operational positions via the electronically controlled universal actuator module 28. For example, the equalizing valve attachment may be actuated between a first position in which all flow along interior 44 moves downhole and a second position which opens an annulus port and creates pressure equalization for the pressure build up test.

Another example of application-specific attachment 30 comprises a tractoring valve attachment which may be actuated to facilitate tractor operation. The tractoring valve attachment may be shifted between operational positions via the electronically controlled universal actuator module 28. For example, the tractoring valve attachment may be actuated between a first position in which 100% of the flow moves down through interior 44 and a second position in which the flow is diverted to a tractor to enable a desired tractor operation.

Another example of application-specific attachment 30 comprises an indexing tool attachment which may be actuated to provide indexing of elements downhole. The indexing tool attachment may be shifted between operational positions via the electronically controlled universal actuator module 28. For example, the indexing tool attachment may be actuated between a first position for standard operation and a second position in which a sleeve is shifted to initiate a fishing operation. The indexing tool attachment also may comprise a third position allowing tool elements to be rotated a desired angle, e.g. 15°, to facilitate the fishing operation. Force feedback may be provided via suitable sensors to indicate appropriate engagement.

Another example of application-specific attachment 30 comprises a dump bailer attachment which may be selectively actuated. The dump bailer attachment may be shifted between operational positions via the electronically controlled universal actuator module 28. For example, the dump bailer attachment may be actuated between a first standard operating position and a second position in which a dump bailer chamber is opened for small collection volumes. The dump bailer attachment also may comprise a third position which closes the bailer to, for example, contain a wellbore fluid sample.

Another example of application-specific attachment 30 comprises a ball dropper attachment which may be actuated to selectively drop balls for use in downhole actuation. The ball dropper attachment may be shifted between operational positions via the electronically controlled universal actuator module 28. For example, the ball dropper attachment may be actuated between a first standard operating position and a second position which opens the ball dropper to dump one ball set. The ball dropper attachment also may comprise a third position which opens a secondary number of ball dropper valves.

Another example of application-specific attachment 30 comprises a sliding sleeve attachment which may be actuated to perform a desired function downhole. The sliding sleeve attachment may be shifted between operational positions via the electronically controlled universal actuator module 28. For example, the sliding sleeve attachment may be actuated between standard operation, engagement, and shifting positions. Suitable sensors 60 may be used to provide positive feedback as to the position of the sliding sleeve.

Another example of application-specific attachment 30 comprises a broadband precision attachment which may be actuated between operational positions. The broadband precision attachment may be shifted between operational positions via the electronically controlled universal actuator module 28. For example, the broadband precision attachment may be actuated between positions of standard operation, engagement with a suitable valve, and pressure equalization/reverse circulation.

Another example of application-specific attachment 30 comprises a jetting attachment which may be actuated to initiate jetting operations downhole. The jetting attachment may be shifted between operational positions via the electronically controlled universal actuator module 28. For example, the getting attachment may be actuated between a first standard operation position with circulation down and a second position in which the jet ports are open for the jetting operation. Depending on the downhole application, the attachment may be constructed for shifting to various third positions.

Another example of application-specific attachment 30 comprises a reverse circulation attachment which may be actuated to perform a desire downhole circulation operation. The reverse circulation attachment may be shifted between operational positions via the electronically controlled universal actuator module 28. For example, the reverse circulation attachment may be actuated between a first position which is a standard, engaged position with circulation down and a second position in which a sleeve is shifted to allow reverse circulation.

Another example of application-specific attachment 30 comprises a kick out tool attachment which may be actuated to shift a tool between orientations downhole. The kick out tool attachment may be shifted between operational positions via the electronically controlled universal actuator module 28. For example, the kick out tool attachment may be actuated between a first standard, straight position with circulation down and a second position in which the tool kicks out to one side, e.g. a position forcing the tool against the surrounding tubing/casing. The kick out tool attachment also may comprise a third position in which fluid is directed down or to the side.

As described above, a variety of application-specific attachments 30 may be used and interchanged with the universal actuator module 28. Additionally, the size, construction, and components of the universal actuator module 28 may be adjusted to accommodate the desired actuation of attachments 30. The universal actuator module 28 may comprise a variety of motors, pumps, mechanical actuation mechanisms, motor controllers, sensors, and/or other components and features as desired for certain downhole operations. Similarly, the well string may comprise various conveyance equipment such as the coiled tubing described above. Depending on the environment and application, the well string may incorporate many other components and features. Similarly, the control system 36 may be located at the surface and/or at other locations and may be configured with various types of hardware and software to enable the desired control over downhole operations.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A method for use in a well, comprising:

providing a universal actuator module which may be coupled with any selected application-specific attachment of a plurality of application-specific attachments, wherein the plurality of application-specific attachments comprise respective pistons configured to change respective actuations of the plurality of application-specific attachments after coupling to the universal actuator module;

positioning the universal actuator module along a well string;

selectively coupling an application-specific attachment of the plurality of application-specific attachments to the universal actuator module, wherein the universal actuator module is configured to direct actuating fluid to a first side of a piston of the application-specific attachment to cause an actuation of the application-specific attachment and direct the actuating fluid to a second side of the piston of the application-specific attachment to cause a different actuation of the application-specific attachment, wherein the piston is configured to move to an operational flow position in response to receiving the actuating fluid at the first side of the piston, and wherein the operational flow position is configured to direct a fluid along a first flow path through a coiled tubing;

conveying the well string downhole; and electrically controlling the universal actuator module to cause the actuation of the application-specific attachment or the different actuation of the application-specific attachment.

2. The method as recited in claim 1, wherein positioning comprises coupling the universal actuator module to a coiled tubing.

3. The method as recited in claim 1, further comprising performing a downhole well operation after the specific actuation of the application-specific attachment.

4. The method as recited in claim 1, wherein electrically controlling comprises providing electric control signals to the universal actuator module from a surface located electronic control system.

5. The method as recited in claim 1, wherein providing the universal actuator module comprises providing the universal actuator module with an electric motor, and wherein electrically controlling comprises controlling operation of the electric motor.

6. The method as recited in claim 5, wherein the universal actuator module comprises a pump connected to the electric motor, the pump being operated to pump hydraulic actuating fluid to the application-specific attachment.

7. The method as recited in claim 5, further comprising using sensors to monitor actuation of the application-specific attachment.

8. The method as recited in claim 6, further comprising forming the application-specific attachment as a valve.

9. The method as recited in claim 8, wherein using sensors comprises using pressure sensors to monitor operational positions of the valve.

10. The method as recited in claim 7, wherein using sensors comprises using a temperature sensor, using a voltage sensor to monitor voltage at the motor, using a current sensor to monitor current at the motor, or using a speed sensor to monitor rotational speed of the motor, or a combination thereof.

11. The method as recited in claim 1, further comprising forming the application-specific attachment as a multi-cycle circulating valve.

12. The method as recited in claim 1, further comprising forming the application-specific attachment as a straddle packer.

13. The method as recited in claim 1, further comprising forming the application-specific attachment as an emergency disconnect.

14. The method as recited in claim 1, further comprising forming the application-specific attachment as a multilateral reentry system tool.

15. A method, comprising:

selectively coupling a universal actuator module with an application-specific attachment of a plurality of application-specific attachments, wherein the universal actuator module is configured to direct actuating fluid to a first side of a piston of the application-specific attachment to cause an actuation of the application-specific attachment and direct the actuating fluid to a second side of the piston of the application-specific attachment to cause a different actuation of the application-specific attachment, wherein the piston is configured to move to an operational flow position in response to receiving the actuating fluid at the first side of the piston, and wherein the operational flow position is configured to direct a fluid along a first flow path through a coiled tubing;

connecting the universal actuator module to the coiled tubing;

positioning the application-specific attachment along a wellbore to perform a downhole operation;

controlling the application-specific attachment to cause the actuation or the different actuation according to instructions provided via electrical control signals transmitted downhole from the surface to the universal actuator module; and using sensors to provide feedback with respect to operation of the application-specific attachment.

16. The method as recited in claim 15, further comprising decoupling the application-specific attachment and subsequently coupling another application-specific attachment to the universal actuator module.

17. The method as recited in claim 15, wherein the piston is configured to move to a different operational flow position in response to receiving the actuating fluid at the second side of the piston, wherein the different operational flow position is configured to direct a fluid along a second flow path through the coiled tubing.

18. A system, comprising:

an application-specific attachment positioned along a well string, the application-specific attachment being configured to control flow of fluid used in a well operation, further comprising additional application-specific attachments interchangeable with the application-specific attachment initially coupled with the universal actuator module;

a universal actuator module coupled with the application-specific attachment, the universal actuator module having a motor, a pump connected to the motor, and a motor controller, the universal actuator module being coupled into the well string such that the pump is able to supply actuating fluid to the application-specific attachment so as to provide controlled actuation of the application-specific attachment according to electronic signals received by the motor controller, wherein the universal actuator module is configured to direct actuating fluid to a first side of a piston of the application-specific attachment to cause an actuation of the application-specific attachment and direct the actuating fluid to a second side of the piston of the application-specific attachment to cause a different actuation of the application-specific attachment, wherein the piston is configured to move to an operational flow position in response to receiving the actuating fluid at the first side of the piston, and wherein the operational flow position is configured to direct a fluid along a first flow path through a coiled tubing; and a sensor system having sensors located to provide feedback to the motor controller regarding the operational position of the application-specific attachment.

* * * * *